US005775196A

United States Patent [19]

Henriksson et al.

[11] Patent Number: 5,775,196

[45] Date of Patent: Jul. 7, 1998

[54] VALVE ARRANGEMENT IN COMPRESSED AIR DRIVEN MOTORS

[75] Inventors: Roland Henriksson, Nacka; Ake Nilsson, Enskede, both of Sweden

[73] Assignee: Atlas Copco Berema AB, Nacka, Sweden

[21] Appl. No.: 693,245

[22] PCT Filed: Feb. 28, 1995

[86] PCT No.: PCT/SE95/00208

§ 371 Date: Aug. 16, 1996

§ 102(e) Date: Aug. 16, 1996

[87] PCT Pub. No.: WO95/23049

PCT Pub. Date: Aug. 31, 1995

[30] Foreign Application Priority Data

Feb. 28, 1994 [SE] Sweden ..... 9400684
Feb. 28, 1994 [SE] Sweden ..... 9400685

[51] Int. Cl.[6] ..... F01L 25/04

[52] U.S. Cl. ..... 91/299; 91/317

[58] Field of Search ..... 91/299, 317, 325

[56] References Cited

U.S. PATENT DOCUMENTS 4,446,773 5/1984 Emonet .

FOREIGN PATENT DOCUMENTS 878048 1/1943 France ..... 91/317
344014 11/1921 Germany ..... 91/317
2 018 904 10/1979 United Kingdom .

*Primary Examiner*—F. Daniel Lopez
*Attorney, Agent, or Firm*—Frishauf, Holtz, Goodman, Langer & Chick

[57] ABSTRACT

In a valve arrangement in pneumatic impact motors (10), the housing (40) of a distribution valve has the form of a plastic bowl (46) which is flanged outwardly at the opening and the bottom thereof. A flat valve (50) is movable between the bowl bottom, which forms one valve seat (51) of the valve housing (40), and a bowl cover member (53), which forms the other valve seat (52). The bowl flanges (47, 48) define therebetween a groove which connects with a delivery channel (39) provided in the impact motor (10), this channel delivering compressed air to the flat valve (50) mounted inside the bowl (46). The bowl wall located between the flanges (47, 48) includes calibrated side openings (57, 58) which control the delivery of compressed air to respective valve seats (51, 52) on respective sides of the flat valve (50), this air delivery being an adapted and calibrated delivery.

2 Claims, 3 Drawing Sheets

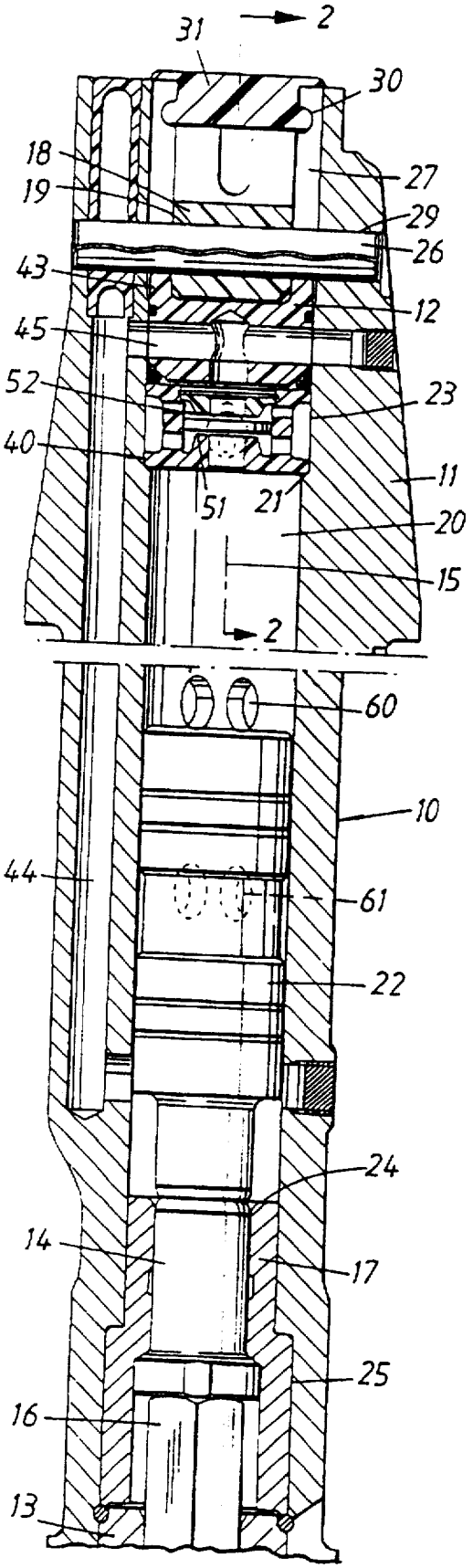
Fig. 1
Fig. 4
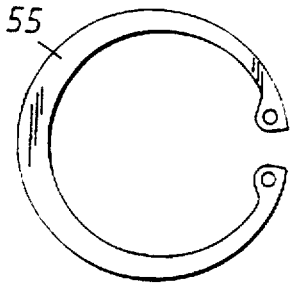

VALVE ARRANGEMENT IN COMPRESSED AIR DRIVEN MOTORS

BACKGROUND OF THE INVENTION

1. Field of the Invention

The present invention relates to a valve arrangement in compressed-air operated impact motors comprising a machine housing having a cylinder and a bore connecting therewith, a valve housing mounted in the bore and supporting a flat valve which is movable in the valve housing between a front valve seat and a rear valve seat, wherein the rear valve seat is connected to the end of the cylinder that is located distal from the bore through channels provided in the machine housing, and the front valve seat is open towards the cylinder at a location adjacent the bore, wherein compressed air is delivered to the space between the valve seats through a delivery channel which opens laterally into the bore, and wherein a hammer piston is sealingly guided for reciprocating movement in the cylinder in response to movement of the flat valve and the hammer piston, said movement being governed by the alternating effect of compressed air on both sides of the hammer piston and the subsequent release of air through air-ventilation openings in a centre part of the cylinder.

2. Description of the Related Art

As illustrated in UK Patent Application GB 2 018 904 for instance, valve arrangements of this kind are normally comprised of metal components which need to be precision made and to fit accurately with one another in their assembled state, i.e. are dependent on time-consuming and expensive machining processes. Another drawback is that in the case of hand-carried machines, the metal components cause the machines to be relatively heavy and troublesome to the user and also tend to cause rust problems after the machine has been used for a long period of time. Furthermore, conventional valve housing components have a form which do not enable the components to be readily exchanged constructively in practice for components that are lighter in weight and that are made of a corrosion-resistant material. The conventional valve housing parts may also include small components, which also makes such an exchange difficult to achieve in practice.

OBJECTS AND SUMMARY OF THE INVENTION

The object of the present invention is to provide valve arrangements or assemblies of the aforesaid kind with which the aforementioned drawbacks with regard to weight, cost and durability are eliminated, and therewith give the valve housing a form which will enable the housing to be manufactured conveniently from plastic material, such as to enable the housing to be assembled and fitted immediately without needing to machine the housing components to precise finishes, therewith lowering the cost of the valve housing. Another object is to construct the valve housing so that the airflow to the valve seats in the housing interior can be calibrated appropriately in a manner to optimize the reciprocating movement of the impact breaker. These objects are achieved with an inventive valve arrangement having the characteristic features set forth in the following claims.

In accordance with the present invention, a valve arrangement in compressed-air operated impact motors (10) includes a machine housing (11) having a cylinder (20) and a bore (23) connecting therewith, a valve housing (40) mounted in the bore (23) and supporting a flat valve (50) which is movable in the valve housing between a front valve seat (51) and a rear valve seat (52). The rear valve seat (52) is connected to the end of the cylinder (20) that is located distal from the bore (23) through channels (44, 45) provided in the machine housing (11), and the front valve seat (51) is open towards the cylinder (20) at a location adjacent the bore (23). The compressed air is delivered to the space between the valve seats (51, 52) through a delivery channel (39) which opens laterally into the bore (23). A hammer piston (22) is sealingly guided for reciprocating movement in the cylinder (20) in response to movement of the flat valve (50) and the hammer piston (22), said movement being governed by the alternating effect of compressed air on both sides of the hammer piston (22) and the subsequent release of air through air-ventilation openings (60, 61) in a center part of the cylinder (20). The valve housing (40) has the form of a plastic bowl (46) which is outwardly flanged at the bowl mouth and at the bowl bottom. The flat valve (50) is movable between the bowl bottom, which forms the one valve seat (51), and a bowl cover member (53) for the bowl mouth which forms the other valve seat (52). The flanges (47, 48) lie against the wall of the bore (23) and define therebetween a groove (54) which connects with the delivery channel (39) and which functions to deliver compressed air to the flat valve (50) inside the bowl through the medium of side openings (57, 58) provided in the bowl wall between the flanges (47, 48) on both sides of an undivided bowl wall portion that encircles the region of the length of the working stroke of the flat valve (50).

BRIEF DESCRIPTION OF THE DRAWINGS

The present invention will now be described in more detail with reference to the accompanying drawings, in which FIG. 1 is a partially fragmented longitudinal section view of an impact breaker, which in the illustrated embodiment is a pneumatic pick, fitted with an inventive valve arrangement;

FIGS. 3A–3D are cross-sectional views which illustrate the four components that form the valve arrangement in FIG. 1, these components being shown in a slightly enlarged and exploded presentation, wherein FIG. 3A shows the valve housing, FIG. 3B the flat valve, FIG. 3C the cover member, and FIG. 3D the stop ring;

FIG. 4 shows the stop ring of FIG. 3D from above; and

DETAILED DESCRIPTION OF THE PREFERRED EMBODIMENTS

Figure 2:
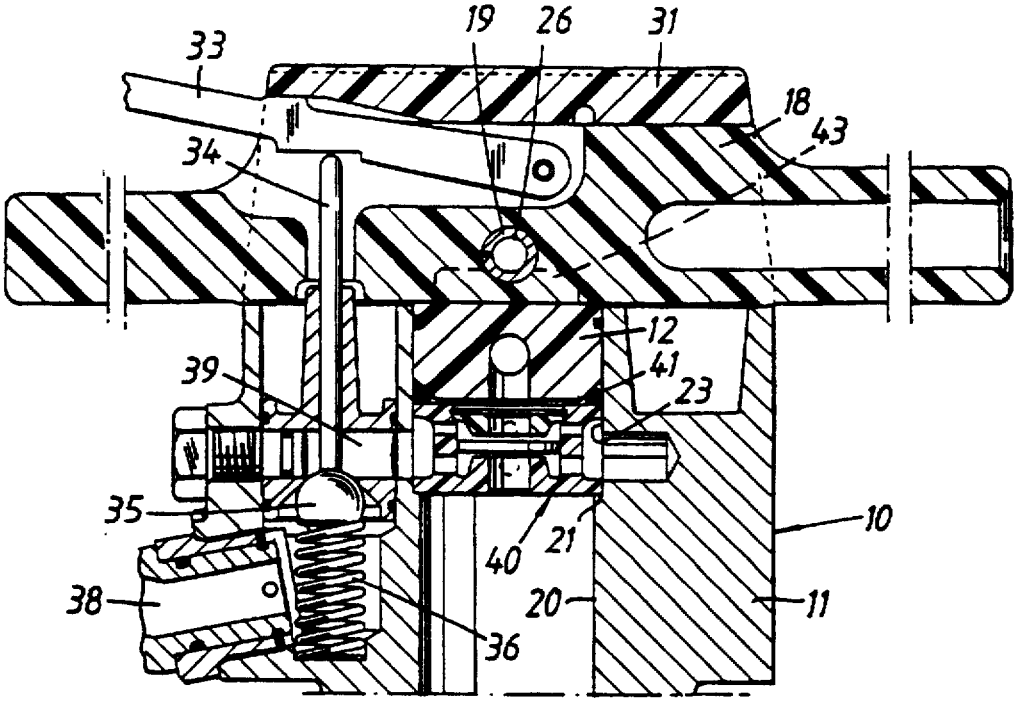
FIG. 2 is a sectional view seen along the line 2—2 in FIG. 1.

The pneumatic pick 10 shown in FIG. 1 comprises a machine housing 11 which includes a back piece 12 provided with a handle part 18, and a front piece 13, these components being held together in the intermediate machine housing 11 in line with one another along the central axis 15 of a cylinder 20 mounted in the machine housing 11. The cylinder 20 is extended rearwardly via an annular shoulder 21 in an enlarged bore 23, and forwardly in a front bore 25. The bore 25 accommodates an intermediate part 17 which projects sealingly into the cylinder 20 and has an annular end surface 24 which faces towards the cylinder. The intermediate member 17 serves as a rear guide bushing or sleeve for guiding movement of an intermediate block 14 which transmits impact forces to the tool 16. The tool 16 is guided for limited axial movement in the front piece 13 and the journal bearing and locking means used to this end are of a conventional design. A detailed description in this regard is found, for instance, in Patent Specification SE 9400685-5 and need not therefore be dealt with in further detail in this document. The machine housing 11 is provided rearwardly with two side walls 27 which project rearwardly beyond the back piece 12, over the central part of the handle part 18. The handle part 18 is fixed to the machine housing 11 between the side walls 27, by means of a wedge 26 which is passed through a transverse bore 19 in the centre of the handle part 18 and pressed into coaxial bores 29 at the side walls 27. The handle part 18 supports rearwardly against a cover member 31, suitably made of a plastic material (polyurethane) and pushed laterally into opposed grooves or slots 30 at the side walls 27.

The handle part 18 supports inwardly of the cover member 31 a laterally extending pivotal lever arm 33. As the lever arm 33 is swung towards or away from the handle part 18, an intermediate pin 34 projecting into the housing 11 is activated so as respectively to open or close a governor valve 35, said valve being biased in a valve closing direction by means of a valve spring 36. The valve 35 functions to open or close a connection between a compressed-air inlet 38 and a delivery channel 39 provided in the housing 11 and opening laterally into the bore 23 at a location adjacent the shoulder 21.

The impact motor illustrated in FIG. 1 also includes a distribution-valve housing 40 which rests against the shoulder 21 in the bore 23 and forms the cylinder head of the cylinder 20. The back piece 12 has the form of a plug which is made of a plastic material (polyurethane) or, when necessary, of metal and which is inserted sealingly in the bore 23 from the rear and functions to hold the distributor-valve housing 40 axially in abutment with the annular shoulder 21 in the bore 23, through the medium of a peripheral sealing ring 41. The back piece 12 includes two mutually opposing recessed or cupped shoulders 43, as shown at 42, FIGS. 1 and 2 and 6, which are directed rearwardly on both sides of the handle part 18 and support against the wedge 26, such as to lock the back piece 12 axially in the bore 23 between the valve housing 40 and the wedge 26. The back piece 12 further includes a transverse passageway or channel 45 which is open centrally towards the valve housing 40 and which connects with a passageway or channel 44 which opens into the cylinder 20 at a location distanced from the bottom 24.

A hammer piston 22 is sealingly guided for reciprocating movement in the cylinder 20 and in the illustrated case functions to impart an impact force to the tool 16 via the intermediate block 14, FIG. 1. Alternatively, the front part of the pneumatic pick 10 can be modified so that the hammer piston will strike directly on the tool 16. When the hammer piston 22 approaches the end of its stroke, that side of the piston which is under pressure is ventilated through a respective air-ventilating opening 60 or 61 provided in the cylinder 20, said air being ventilated to the surroundings of the machine housing 11.

Figure 3D:
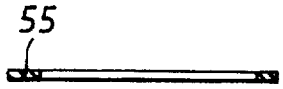
Figure 3C:
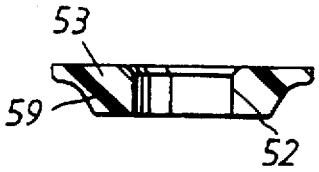
Figure 3B:
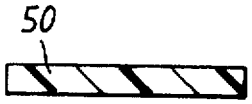
Figure 3A:
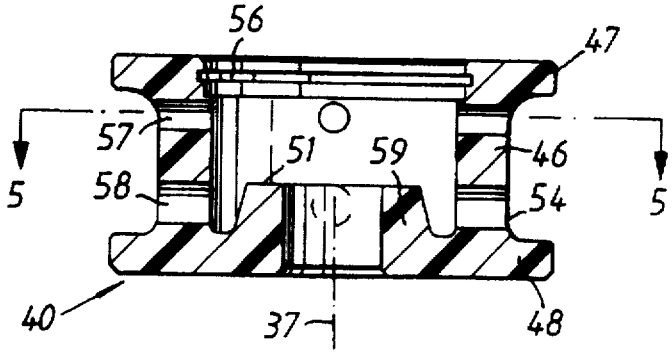
Figure 5:
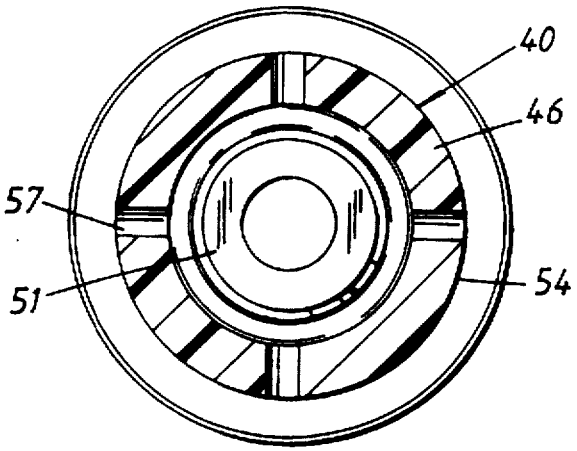
FIG. 5 is a sectional view of the valve housing seen along the line 5—5 in FIG. 3A.

The valve housing 40 (FIG. 3A) is injection-moulded from a plastic material, preferably from acetal plastic (Delrin) and has the form of an outwardly flanged or lipped bowl 46 which is symmetrically rotational in relation to a centre axis 37 and includes a circumferentially extending groove 54 defined between an upper flange 47 and a lower flange 48. A similarly plastic (acetal plastic) flat valve 50 (FIG. 3B) can be inserted in the bowl 46 inwardly of the groove 54 and moves axially between a forward valve seat 51, which forms the bottom of the bowl 46 and which when assembled in the machine housing 11 is open towards the cylinder 20, and a rearward valve seat 52 which is open towards the transverse channel 45 in the back piece 12. The symmetry axis 37 of the valve housing 40 passes through the centre of the valve seat 51 in the bottom of the bowl 46. The rear valve seat 52, which is also made of acetal plastic, forms a bowl cover, member 53 (FIG. 3C) and can be fixed in a slightly lowered position within the opening or mouth of the bowl 46 and essentially flush with the upper flange 47, with the aid of a stop ring 55 (FIGS. 4 and 3D) inserted in a locking groove 56.

Calibrated side openings 57, 58 for delivering compressed air to respective sides of the flat valve 50 are provided in the bowl 46 between the flanges 47, 48. The side openings 57, 58 are uniformly distributed peripherally and are, for instance, four in number for each valve seat 51, 52. The side openings 58 leading to the front valve seat 51 are calibrated experimentally to a greater degree than the side openings 58 such as to achieve a greater impact force of determined value during a working stroke. That part of the bowl wall which extends between the side openings 57, 58 is imperforate and surrounds the region travelled by the valve 50 between the valve seats 51, 52, i.e. the working stroke of the valve, so that compressed air injected into the valve housing 40 will not impinge on the flat valve 50. The length of stroke of the valve is limited by annular walls 59 extending around the valve seats 51, 52, with the side openings 57, 58 lying on the same level as the walls. If desired, the valve 40 may alternatively be fitted in the bore 23 with the cover member and the valve seat 52 facing towards the cylinder 20.

When the pneumatic pick 10 is handled by the operator and pressed against a working surface with the aid of the handle part 18, the components of the impact motor will be in the positions shown in FIG. 1. When activating the pressure arm 33, compressed air is delivered from the mains-connected outlet 38 to the inlet valve 35 and the delivery channel 39 and hence to the bore 23 and the valve housing 40. It is assumed that the flat valve 40 covers the front valve seat 51 and that compressed air is passed to the cylinder bottom 24 through the rear valve seat 52, the transverse channel 45 in the back piece 12, and the channel 44, so as to move the hammer piston 22 away from the tool 16, and the cylinder 20 is ventilated beneath the hammer piston 22 via the ventilating openings 61 as the piston approaches the end of its return stroke in the cylinder 20. As a result of the drop in pressure caused by ventilating the cylinder, in combination with the increase in pressure in front of the returning hammer piston 22, the flat valve 50 is thrown over against the rear valve seat 52. Compressed air now enters above the hammer piston 22, causing the piston to turn, and drives the piston into hammer contact with the tool 16, the hammer piston now being in the position shown in FIG. 1. Ventilation of air from the cylinder 20 above the hammer piston 22, through the ventilating opening 60, in combination with the increase in pressure beneath the hammer piston 22 throws the flat valve 50 back onto the forward valve seat 51 and the hammer piston 22 therewith continues to move reciprocatingly with repetition of the aforedescribed cycle.

The possibility of injection-moulding the valve housing 40 from a plastic material is able to provide a durable and inexpensive advantageous construction which permits the distribution valve to be assembled and fitted without requiring the valve to be accurately machined. There is also obtained a repetitive uniform quality with small deviations in tolerances. The mould is constructed so that it can be separated sideways to enable the mould to be parted when the flanges 47, 48 have been moulded, and comprises four parts which can be exchanged to enable side openings 57, 57 of mutually different sizes to be moulded in accordance with the size of the impact tool and the mechanical effect for which the distribution valve is intended.

We claim:

1. A compressed-air operated impact motor (10) comprising:

a machine housing (11) having a cylinder (20) and a bore (23) connecting therewith;

a valve housing (40) mounted in the bore (23) and supporting a flat valve (50) which is movable in the valve housing between a front valve seat (51) and a rear valve seat (52);

wherein the rear valve seat (52) is connected to the end of the cylinder (20) that is located distal from the bore (23) through channels (44, 45) provided in the machine housing (11), and the front valve seat (51) is open towards the cylinder (20) at a location adjacent the bore (23);

wherein compressed air is delivered to the space between the valve seats (51, 52) through a delivery channel (39) which opens laterally into the bore (23); and wherein a hammer piston (22) is sealingly guided for reciprocating movement in the cylinder (20) in response to movement of the flat valve (50) and the hammer piston (22), said movement being governed by the alternating effect of compressed air on both sides of the hammer piston (22) and the subsequent release of air through air-ventilation openings (60, 61) in a center part of the cylinder (20);

the valve housing (40) having the form of a plastic bowl (46) which is outwardly flanged at the bowl mouth and at the bowl bottom and in which the flat valve (50) is movable between the bowl bottom, which forms the one valve seat (51), and a bowl cover member (53) for the bowl mouth which forms the other valve seat (52), wherein the flanges (47, 48) lie against the wall of the bore (23) and define therebetween a groove (54) which connects with the delivery channel (39) and which functions to deliver compressed air to the flat valve (50) inside the bowl through the medium of side openings (57, 58) provided in the bowl wall between the flanges (47, 48) on both sides of an undivided bowl wall portion that encircles the region of the length of the working stroke of the flat valve (50);

wherein the bowl cover member (53) is made of a plastic material and forms a detachable bowl closure for the bowl mouth, attached to the valve housing (40) with the aid of a stop ring (55).

2. A compressed-air operated impact motor according to claim 1, wherein the length of the working stroke of the flat valve (50) in the bowl (46) is limited by annular walls (59) located around and forming the valve seats (51, 52), said walls (59) being situated on the same level as the level on which the side openings (57,58) are situated, and the side openings (57, 58) being calibrated to determine the reciprocating movement of the hammer piston (22) by virtue of controlling the compressed-air supply to the regions of the bowl (46) around respective walls (59) of the valve seats (51, 52).

* * * * *